US006705780B2

(12) United States Patent
Earle et al.

(10) Patent No.: US 6,705,780 B2
(45) Date of Patent: Mar. 16, 2004

(54) PROCESSOR

(75) Inventors: Anthony Earle, Harrow Weald (GB); Leslie Wells, London (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/219,710

(22) Filed: Aug. 15, 2002

(65) Prior Publication Data

US 2003/0035654 A1 Feb. 20, 2003

(30) Foreign Application Priority Data

Aug. 20, 2001 (GB) ..... 0120189

(51) Int. Cl.[7] ..... G03D 11/04; G03D 17/02

(52) U.S. Cl. ..... 396/634; 396/635; 396/636; 396/646; 355/27; 134/64 P; 134/122 P

(58) Field of Search ..... 396/612, 613, 396/620, 625, 633–636, 641, 646; 355/27–29; 134/64 P, 122 P, 64 R, 122 R

(56) References Cited

U.S. PATENT DOCUMENTS

| | | | | |
|---|---|---|---|---|
| 3,977,876 | A | 8/1976 | Ratowsky | 396/634 |
| 4,269,501 | A | 5/1981 | Griffith et al. | 396/625 |
| 4,307,955 | A | 12/1981 | Cocco et al. | 396/599 |
| 5,414,485 | A | 5/1995 | Fyson | 396/635 |
| 5,508,776 | A | 4/1996 | Rosenburgh et al. | 396/620 |

*Primary Examiner*—D. Rutledge
(74) *Attorney, Agent, or Firm*—Frank Pincelli

(57) ABSTRACT

A processor for processing photosensitive material has a rotatable outer drum and an inner sprocket wheel which is independently rotatable from the outer drum. Two sets of sprocket teeth and, are provided on the sprocket wheel to engage with the material to be processed and to positively drive the material into and out of the processor.

6 Claims, 8 Drawing Sheets

PROCESSOR

CROSS REFERENCE TO RELATED APPLICATIONS

This is a U.S. original patent application which claims priority on Great Britain patent application No. 0120189.6 filed Aug. 20, 2001.

FIELD OF THE INVENTION

This invention relates to an apparatus for processing photosensitive material, in particular it relates to the insertion and removal of the photosensitive material from the apparatus.

BACKGROUND OF THE INVENTION

In many processors it is necessary to pull the film out of the film cassette or a loading station prior to the film being fed into processing tanks. To prevent damage to the film it is usual to manually attach a leader card to the leading edge of the film. The pulling and guiding forces as the film passes through the processor are then applied to the leader card instead of to the film itself. These leader cards are normally made of a robust flexible plastics material. As they are used they become damaged and therefore they need to be inspected before they can be re used. It is therefore not possible to use these leader cards in kiosk type processors where there is no operator and where the films are automatically withdrawn and fed into the processor. It is also not possible to use these leader cards in processors such as that disclosed in U.S. patent application Ser. No. 09/920,495, now U.S. Pat. No. 6,505,979, where the film is fed around a narrow path by drive rollers.

To overcome the above mentioned problems, and to provide a positive drive to load and unload the film from a processor a sprocket wheel system has been devised.

SUMMARY OF THE INVENTION

According to the present invention there is provided an apparatus for processing photosensitive material comprising a rotatable outer drum and an inner sprocket wheel independently rotatable from the outer drum, the inner wheel being provided with at least two sets of sprocket teeth for engagement with a strip of material to be processed, two pairs of drive rollers being located around the outer periphery of the drum.

Preferably one set of teeth are spring loaded.

The processor provides a positive drive system for loading and unloading the film. The film is held in position throughout the process and is therefore less likely to be damaged. The film is held in both dry and wet conditions. The pitch of the film does not have to be totally accurate to load into the processor. This allows for variances in the pitch due to film swell or manufacture. During processing there is no relative movement between the outer drum and the inner sprocket wheel. Thus there is no sticking or jamming.

BRIEF DESCRIPTION OF THE DRAWINGS

The invention will now be described, by way of example, with reference to the accompanying drawings, in which.

DETAILED DESCRIPTION OF THE INVENTION

Figure 1:
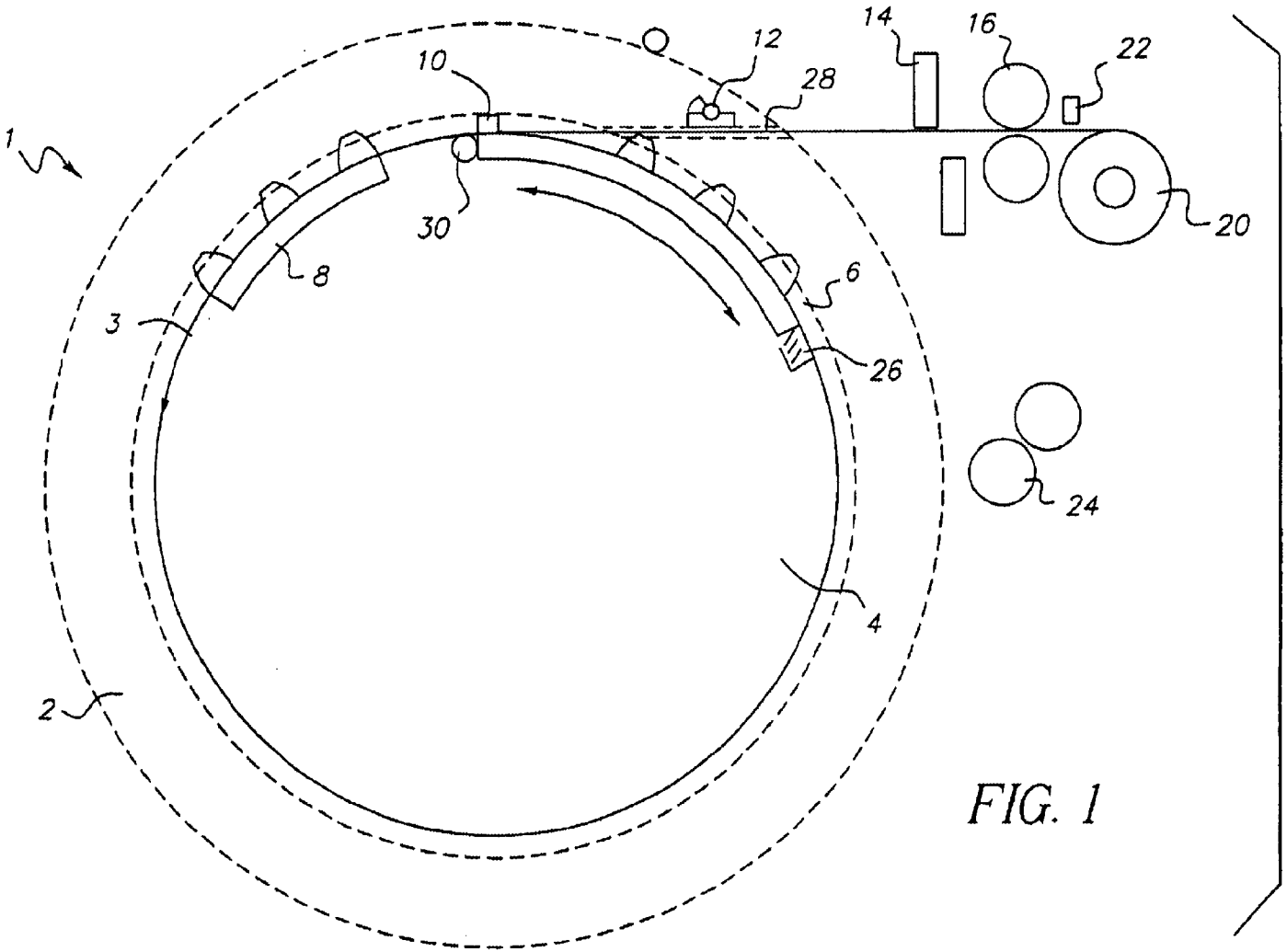
FIG. 1 is a schematic view of a processor according to the invention in the loading position.
Figure 2:
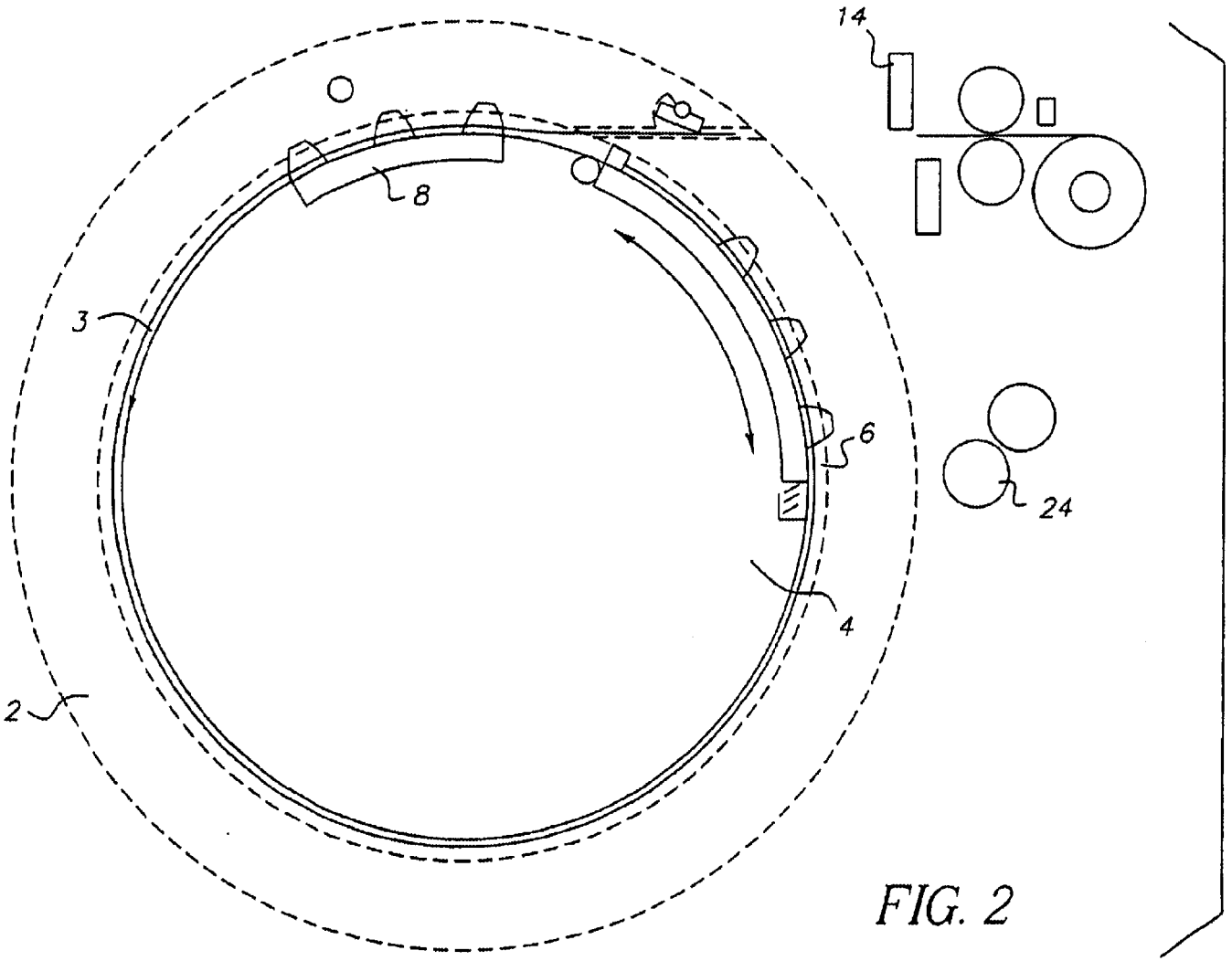
FIG. 2 shows the processor when it is fully loaded.
Figure 3:
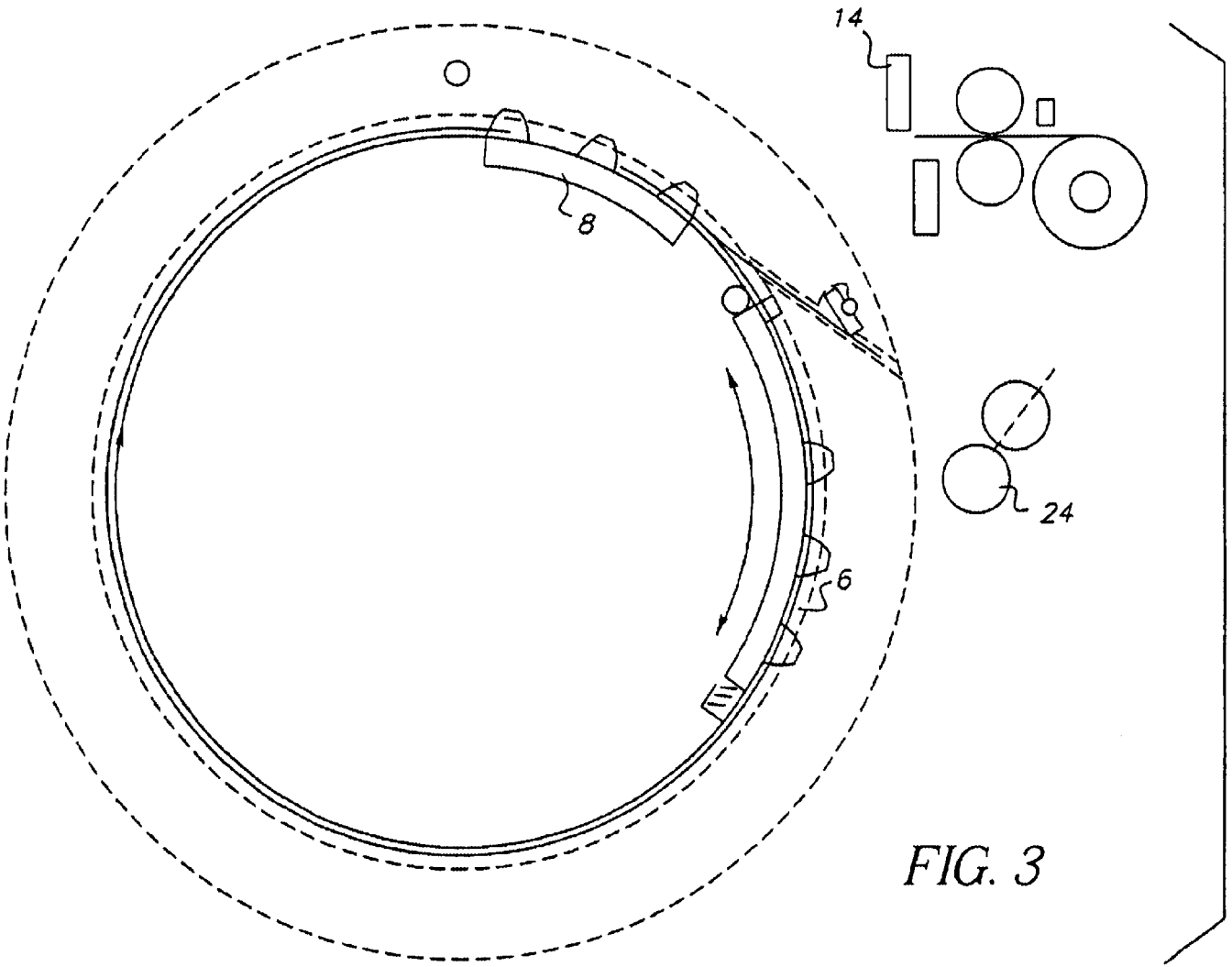
FIG. 3 shows the processor in the unloading position.
Figure 4:
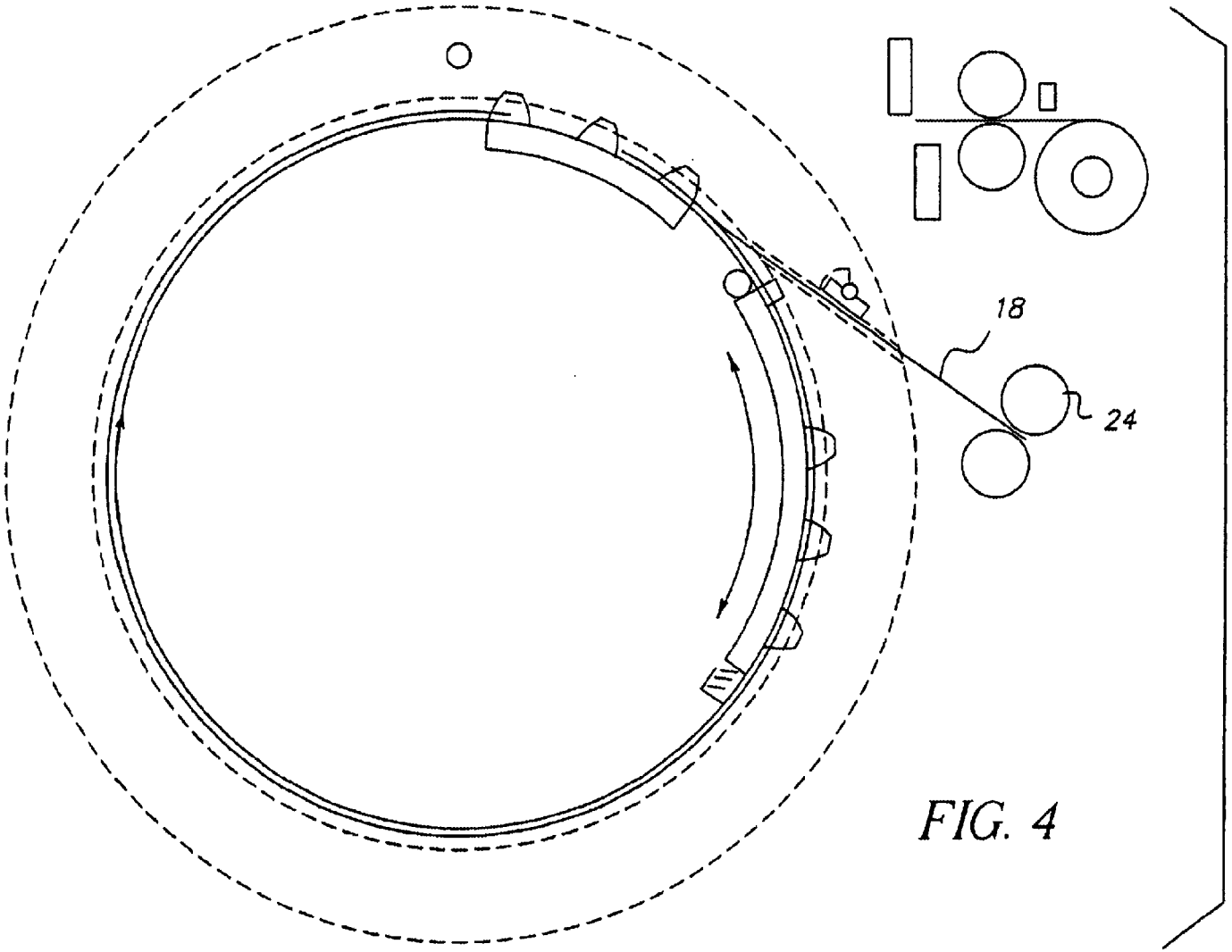
FIG. 4 shows the processor at the start of the unload position.

FIG. 1 shows the processor in the loading position.

The processor 1 comprises an outer drum 2 and an inner sprocket wheel 4. A narrow gap 3 is defined between the outer drum 2 and the inner sprocket wheel 4. The gap can be up to approximately 3 mm wide to give good results. The inner sprocket wheel 4 can be rotated independently of the outer drum 2. Sensors 30 and 32 are located on the inner wheel 4 and outer drum 2 respectively for determining the correct location thereof during loading and unloading. The sprocket wheel 4 may be made of any suitable material which is dimensionally stable. The outer drum 2 may be made of metal and/or plastics material.

The inner wheel 4 is provided with at least two sets of sprocket teeth around the outer periphery thereof. A first set of teeth 6 engage one end of a length of film 18 when the film is loaded into the processor. A second set of teeth 8 engage the other end of the length of film 18 when the film is loaded into the processor. The teeth may be made of a plastics material such as NORYL, ™. This is an example only of the material which may be used and the invention is not limited to such material. The front end of the first set of teeth 6 is provided with a stop member 10. A spring 26 is provided behind the first set of teeth. A feed slot 28 is provided through the wall of the outer drum 2 to enable passage of the strip of film into the processor 1. The feed slot 28 may be closed by a door 12. The door is made of any suitable flexible material, such as rubber.

Two pairs of drive rollers 16, 24 are located outside of the processor 1. The pairs of drive rollers are located at different positions around the circumference of the processor. Drive rollers 16 drive the strip of film 18 into the processor. A knife 14 is provided adjacent the drive rollers 16 on the side nearer to the processor. On the other side of the drive rollers 16 there is provided a sensor 22. Sensor 22 detects the presence of the film. Drive rollers 28 are utilised to remove the strip of film 18 out of the processor.

Figure 5:
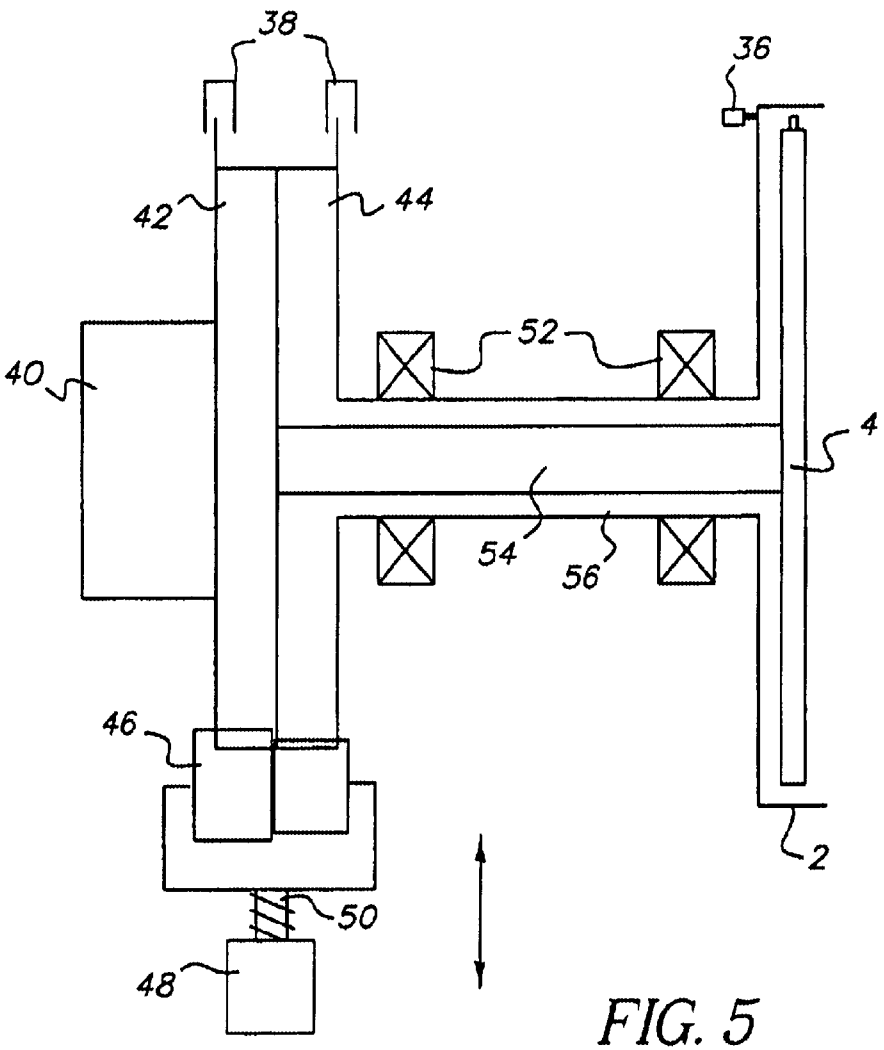
FIG. 5 is a schematic view of the drive arrangement for the processor.

FIG. 5 shows the drive arrangement for the processor.

The outer drum 2 is connected to gear wheel 44 via drive shaft 56. Drive shaft 56 runs in ball race bearings 52. The inner sprocket wheel 4 is connected to gear wheel 42 via drive shaft 54. The drive motor 40 is physically connected to the gear wheel 42. Gears 42 and 44 are spur gears. A pinion 46 is mounted for engagement with both gear wheels 42 and 44. The position of the pinion relative to the gears 42 and 44 is controlled by a solenoid 48 and spring 50. Sensors 38 are provided at periphery of both gear wheels 42 and 44. A locking member 36 is located adjacent the outer drum 2.

When film 18 from a film cassette 20 is to be loaded into the processor 1 for processing the outer drum 2 is locked into a stationary position. The feed slot 28 is in alignment with the drive rollers 16 in this position. Correct alignment can be sensed by sensor 38. It is also possible to have a sensor for detecting the correct unload position. Such a sensor is not shown in the drawings. The inner sprocket wheel 4 remains rotatable.

Sensor 22 detects the presence of the film 18. The drive rollers 16 are started on detection of the film. The rollers are activated for a predetermined set period of time during which the film is loaded into the processor. The door 12 in the processor wall is opened and the strip of film 18 to be processed is fed into the processor 1 via the feed slot 28. The film 18 is driven into the processor by the drive rollers 16. The inner wheel 4 is positioned within the outer drum 2 such that the first set of teeth 6 lies just below the entrance of the feed slot into the interior of the processor 1. As the leading end of the film 18 reaches the end of the feed slot 28 it passes over the first set of sprocket teeth 6 and hits the stop member 10. The inner sprocket wheel 4 starts to rotate in a counter clockwise direction. As the inner wheel 4 rotates the perforations in the film 18 become engaged with the first set of sprocket teeth 6. The inner wheel 4 rotates and takes the film with it. When almost all of the film is within the processor the knife 14 cuts the film to detach it from the film cassette 20. The inner wheel 4 continues to rotate until almost all the length of film 18 is within the gap 3 defined between the inner wheel and the outer drum. The trailing end of the film becomes engaged with the second set of sprocket teeth 8. A short length of film 18 remains in the feeding slot 28. The door 12 is then closed and the outer drum 2 is unlocked from its stationary position. Processing of the film then takes place. Full details of the processing can be found in co-pending U.S. patent application Ser. No. 09/920,495, the contents of which are herein incorporated by reference.

During processing the inner sprocket wheel 4 and the outer drum 2 rotate together. As the processing comes to an end the processor is stopped in a position such that the feed slot 28 is in alignment with the second pair of drive rollers 24. The outer drum 2 is again locked into a stationary position. The door 12 is opened and the inner wheel 4 is rotated. This time the inner wheel is rotated in a clockwise direction. The rotation of the inner wheel drives out the film until it reaches the drive rollers 24. The drive rollers 24 rotate at a speed which matches that of the rotation of the inner wheel 4. This enables the film to remain taut. As the inner wheel rotates all the teeth of the first set of sprocket teeth and the second set of sprocket teeth become disengaged from the film 18. As the film leaves the processing drum it may then be fed into the next stage of the process. This could be a dryer.

The spring 26 located at the rear of the first set of sprocket teeth 6 allows the teeth to engage properly with various pitches of film 18. The pitch may vary due to different types of film and also be dependent on whether the film is wet or dry, hot or cold. The film may vary by up to 0.4% in length during processing.

Figure 6:
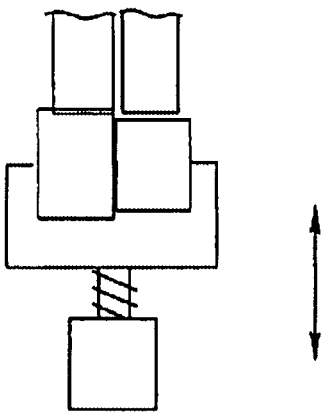
FIG. 6 is a schematic view of the clutch.

When both the inner sprocket wheel and the outer drum are rotating together the pinion 46 engages both gear wheel 42 and gear wheel 44. To lock the outer drum 2 in position a locking member 36 is engaged therewith. The drum is locked in a known position such that the feed slot will be aligned with either the drive rollers 16 or the drive rollers 24. When the inner wheel is to be rotated for either loading or unloading of the film the solenoid 48 is energised. As the solenoid 48 is energised the pinion 46 is withdrawn from full engagement with both gear wheels. The gear teeth on the pinion 46 are shaved on the length of the pinion engaging with gear wheel 44. This means that when the solenoid 48 is energised the pinion can be withdrawn such that it is no longer in engagement with gear wheel 44 but is still just engaged with gear wheel 42. A close up view of this is shown in FIG. 6. When the solenoid is de-energised the spring 48 pushes the pinion 46 back up towards the gears 42 and 44. If the teeth on gear wheel 44 are not in line with the teeth on the pinion 46 the pinion will not engage correctly with the gear wheel 44. The teeth will crown. In this instance the gear wheel 42 is briefly rotated a few degrees in either direction by the drive motor 40. The pinion 46 is thus shuffled by the gear wheel 42 until the teeth properly engage with the teeth of gear wheel 44. Both gear wheels 42 and 44 are then fully engaged.

A major advantage of having the pinion spring-loaded is that should the either the inner sprocket wheel or the outer drum get jammed in any way, for any reason, the pinion 46 will 'jump' out of engagement with the gear wheels. This prevents damage to both the film and the processor. It also provides an audible warning that the drums have jammed due to the noise of the teeth of the pinion jumping.

Figure 7A:
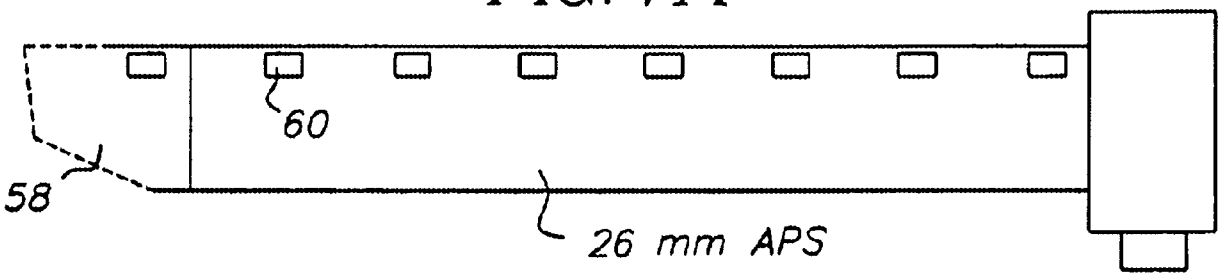
FIGS. 7A and 7B show the film that may be used in the invention.
Figure 7B:
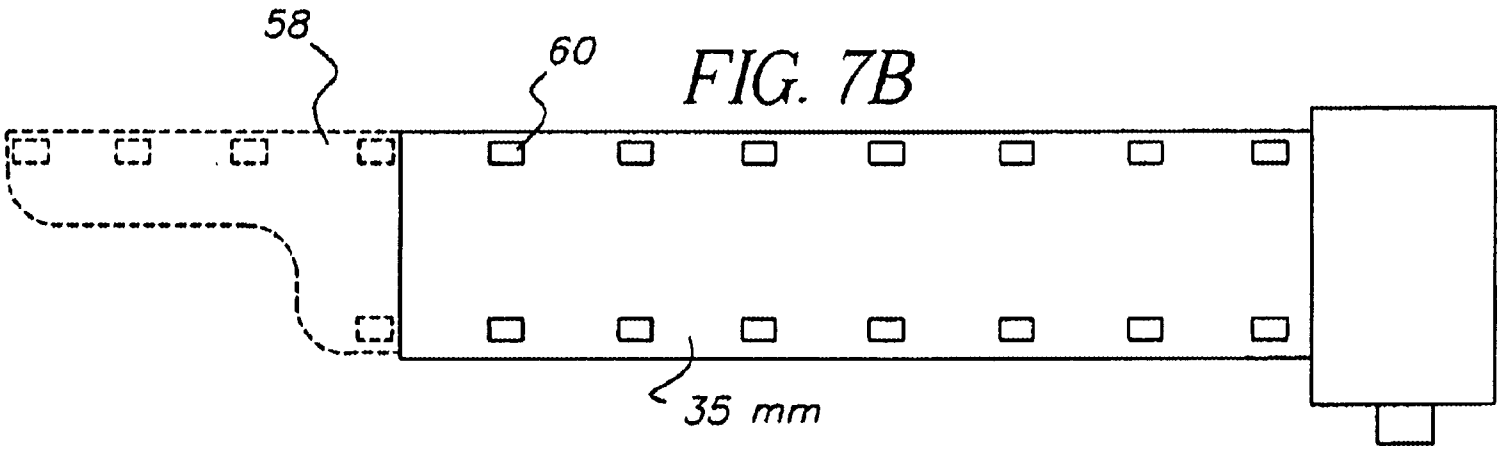

FIGS. 7A and 7B show a typical end of film strip for both 35 mm film and 26 mm APS film. Before processing can take place the tongue 58 must be cut off to enable the strip of film to be fed into the processor. The cut may be made anywhere, preferably not through perforations 60 since this does not give a good strong straight edge. Preferably the cut is made just to either side of a perforation and either side of a picture. It is possible to cut chamfered corners if required to stop the corner of the film catching and jamming in the processor.

Figure 8A:
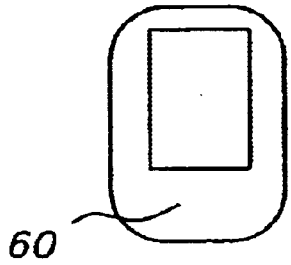
FIGS. 8A and 8B are schematic views of the wall of the processor.
Figure 8B:
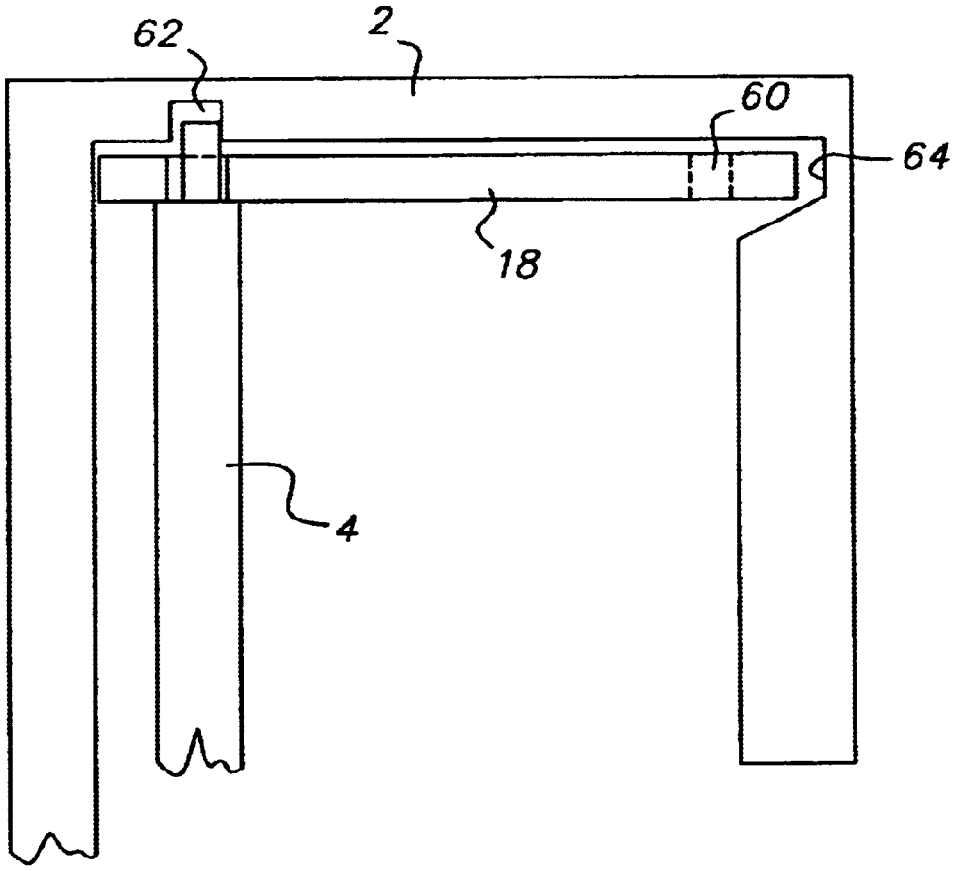

The teeth of the sprocket wheel 4 are only 1.5 mm to 2 mm in height. Thus it would be quite easy for the film 18 to jump out of engagement with the teeth or not engage at all. To avoid this problem a groove 62 is provided in the inner circumferential wall of the outer drum 2. The top of the sprocket teeth run through this groove 62. This is illustrated in FIGS. 8A and 8B. The feeding slot 28 runs into the groove 62. The top of the teeth are approximately 2 mm wide. The perforations in the film 18 are approximately 3 mm wide. This provides enough clearance for the film to easily engage with the teeth. The shape of the teeth may be profiled for easier engagement. The teeth are narrower than the width of the sprocket wheel 4.

The film is engaged on one side only. The outer drum 2 has a further groove 64 located in the inner side wall thereof. The other side of the film 18 runs in this groove 64. The groove may be chamfered to reduce friction and damage to the film. The chamfer will be in the region of 2°.

Figure 9:
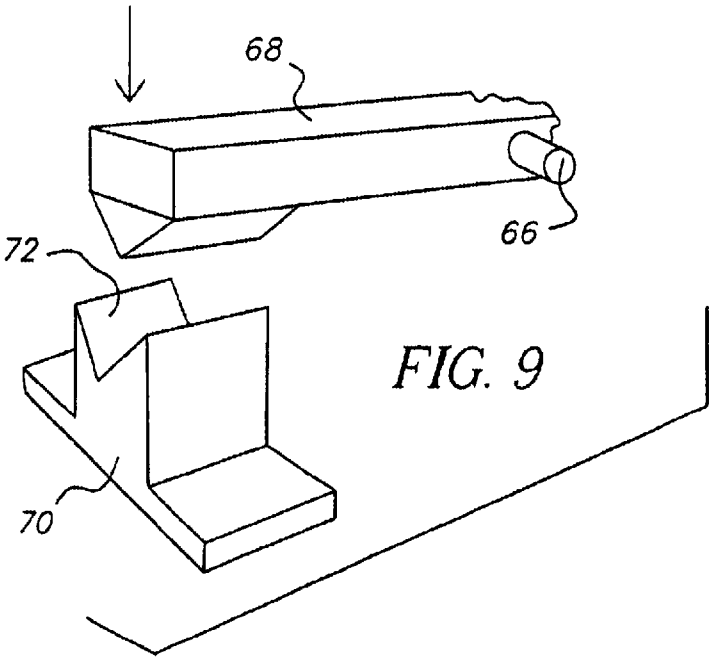
FIG. 9 is a schematic view of the locking mechanism for the processor.

FIG. 9 illustrates the locking mechanism for locking the outer drum in position for loading and unloading of the processor.

The locking mechanism comprises a wedge shaped member 68, operated by means of a solenoid, not shown, a pivot 66 and two receiving members 70, one for locking the drum in the loading position and one for locking the drum in the unloading position. The members 70 are fixed to the outer wall of the outer drum 2 and have a V shaped slot 72. This mechanism accurately locates the drum 2 in the correct location for loading and unloading.

To activate the locking mechanism the solenoid is energised. The movement of the solenoid pushes the wedge shaped member 68, via pivot 66, down into engagement with the member 70. Any slight misalignment of the processor with the locking mechanism can be coped with due to the wedged shape of member 68 and the V shape of the member 70. This V shape also allows the member 68 to cam out of the member 70 should the outer drum 2 be accidentally moved by the inner sprocket wheel 4. Any damage to the sprocket wheel, film or outer drum can thereby be prevented.

Figure 10:
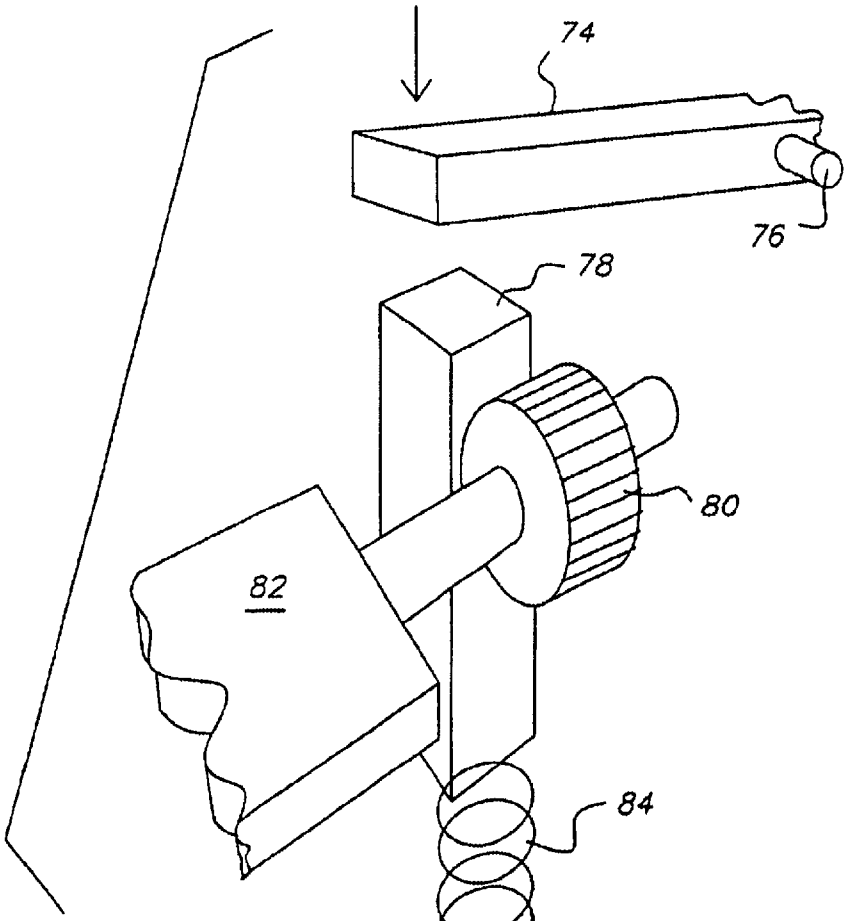
FIG. 10 is a schematic view of the door closing mechanism.

FIG. 10 illustrates the door closing mechanism of the processor.

The door closing mechanism comprises an arm 74, operated by means of a solenoid, not shown, a pivot 76, a rack 78, gear 80 and door member 82. The rack 78 and gear 80 are located on the processor. There are two arms 74 and pivots 76, located adjacent the processor, one for closing the door at the loading position of the processor 1 and one for opening the door at the unloading position of the processor.

The door closing mechanism works in a similar fashion to the locking mechanism described above. When the door is to be opened the solenoid is energised. The movement of the solenoid pushes down the arm 74, via pivot 76, down into contact with rack 78. As the rack is pushed down the gear 80 rotates. The rotation of the gear 80 in turn rotates the door member 82. The door member 82 is rotated to an open position to allow passage of the film 18.

If the solenoid is not energised the door will close. The solenoid is spring loaded so that the arm 74 is withdrawn out of contact with the rack 78 when it is not energised. The rack 78 is also provided with a spring 84. If the arm 74 is not pushing down on the rack, due to the solenoid being switched off, the spring 84 will push the rack 78 upwards. The gear 80 will thus rotate in the opposite direction to when the rack is pushed downwards and the door member 82 will be rotated to a closed position.

It will be understood by those skilled in the art that it is not essential that a solenoid be used in the mechanisms described above. Any prime mover can be used.

The invention has been described with respect to the processing of film material. However the invention may be used with other material, such as paper.

The invention has been described in detail with reference to preferred embodiments thereof. It will be understood by those skilled in the art that variations and modifications can be effected within the scope of the invention.

Parts List

1. Processor
2. Outer drum
3. Gap
4. Inner sprocket wheel
6. set of teeth
8. set of teeth
10. stop member
12. door
14. knife
16. drive rollers
18. film
20. film cassette
22. sensor
24. drive rollers
26. spring
28. feed slot
30. sensor
32. sensor
36. locking member
38. sensor
40. drive motor
42. gear wheel
44. gear wheel
46. pinion
48. solenoid
50. spring
52. bearings
54. shaft
56. shaft
58. tongue
60. perforations
62. groove
64. groove
66. pivot
68. wedge shaped member
70. receiving member
72. slot
74. arm
76. pivot
78. rack
80. gear
82. door member
84. spring

What is claimed is:

1. Apparatus for processing photosensitive material comprising a rotatable outer drum and an inner sprocket wheel independently rotatable from the outer drum, the inner wheel being provided with at least two sets of sprocket teeth for engagement with a strip of material to be processed, two pairs of drive rollers being located around the outer periphery of the drum.

2. Apparatus as claimed in claim 1 wherein the outer drum and the inner sprocket wheel are arranged with a narrow gap therebetween.

3. Apparatus as claimed in claim 1 wherein one set of sprocket teeth is spring loaded.

4. Apparatus as claimed in claim 1 wherein a groove is provided within the inner wall of the outer drum, the top of the sprocket teeth running within the groove.

5. Apparatus as claimed in claim 1 wherein the sprocket teeth have a height of between 1.5 mm and 2 mm.

6. Apparatus as claimed in claim 1 further including a locking mechanism for locking the outer drum in position during loading and unloading of the photosensitive material, the mechanism comprising two substantially v-shaped members located at different positions on the outer circumference of the drum, a wedge shaped member for engagement with one of the v-shaped members, and means for moving the wedged shaped member into and out of engagement with a v-shaped member.

* * * * *